US006612256B1

(12) United States Patent
Martin

(10) Patent No.: US 6,612,256 B1
(45) Date of Patent: Sep. 2, 2003

(54) COMBINATION BOAT AND DISTRESSED BOAT FLOTATION APPARATUS AND RELATED METHODS

(76) Inventor: Calford S. Martin, P.O. Box 3694, St. Thomas (VG), 00803

( * ) Notice: Subject to any disclaimer, the term of this patent is extended or adjusted under 35 U.S.C. 154(b) by 0 days.

(21) Appl. No.: 10/077,396

(22) Filed: Feb. 15, 2002

(51) Int. Cl.[7] ..... B63B 43/02
(52) U.S. Cl. ..... 114/360; 114/68
(58) Field of Search ..... 114/68, 69, 123, 114/219, 345, 348, 360; 441/40, 66

(56) References Cited

U.S. PATENT DOCUMENTS

| | | | | | |
|---|---|---|---|---|---|
| 31,885 | A | | 4/1861 | Goulard | |
| 387,933 | A | | 8/1888 | Travis | |
| 1,133,629 | A | | 3/1915 | Foster | |
| 1,220,876 | A | | 3/1917 | Moore | |
| 2,374,200 | A | * | 4/1945 | Heigis | 441/41 |
| 3,121,888 | A | | 2/1964 | Morgan et al. | |
| 3,264,463 | A | * | 8/1966 | Bonner, Jr. | 362/158 |
| 3,340,842 | A | * | 9/1967 | Winslow | 114/68 |
| 3,822,662 | A | | 7/1974 | Morita et al. | |
| 3,952,350 | A | | 4/1976 | Moucka | |
| 4,063,323 | A | * | 12/1977 | Salvarezza | 441/80 |
| 4,458,618 | A | * | 7/1984 | Tuffier | 114/68 |
| 4,817,555 | A | | 4/1989 | Meinen | |
| 4,864,961 | A | | 9/1989 | Slonski | |
| 4,867,094 | A | | 9/1989 | Binks | |
| 4,996,936 | A | | 3/1991 | Brundritt | |
| 5,051,744 | A | * | 9/1991 | Ewart | 340/984 |
| 5,150,662 | A | * | 9/1992 | Boyd et al. | 114/68 |
| 5,215,031 | A | | 6/1993 | Inman et al. | |
| 5,357,888 | A | | 10/1994 | Insinna | |
| 5,597,335 | A | * | 1/1997 | Woodland | 441/36 |
| 6,070,546 | A | * | 6/2000 | Downey et al. | 114/123 |
| 6,077,138 | A | | 6/2000 | Schulze | |
| 6,125,782 | A | | 10/2000 | Takashima et al. | |
| 6,161,494 | A | | 12/2000 | Pontevolpe et al. | |
| 6,183,328 | B1 | | 2/2001 | Marshall | |
| 6,195,039 | B1 | | 2/2001 | Glass, Jr. | |
| 6,347,970 | B1 | * | 2/2002 | Weinel | 441/80 |
| 6,394,867 | B1 | * | 5/2002 | Bianco | 441/126 |
| 6,431,108 | B1 | * | 8/2002 | Lloveres et al. | 114/360 |
| 6,435,125 | B2 | * | 8/2002 | Mears | 114/360 |
| 6,484,656 | B2 | * | 11/2002 | Mears et al. | 114/68 |
| 2003/0015129 | A1 | * | 1/2003 | Lloveres et al. | 114/360 |

FOREIGN PATENT DOCUMENTS

| | | | | |
|---|---|---|---|---|
| EP | 0568501 A1 | * | 11/1993 | 114/68 |
| FR | 2667567 A | * | 4/1992 | 114/68 |
| GB | 2120177 A | * | 11/1983 | 114/68 |
| GB | 2184401 A | * | 6/1987 | 114/68 |
| WO | WO 9008691 | * | 8/1990 | 114/69 |
| WO | WO 9117915 | * | 11/1991 | 114/68 |

* cited by examiner

*Primary Examiner*—S. Joseph Morano
*Assistant Examiner*—Ajay Vasudeva
(74) *Attorney, Agent, or Firm*—Jeffrey Whittle

(57) ABSTRACT

A combination boat and distressed boat flotation apparatus, a distressed boat flotation apparatus, and methods of installing and using a boat flotation apparatus are provided. The combination preferably includes a boat including a boat hull and a plurality of flotation containers positioned to substantially surround the boat hull and positioned to be inflated with a gas responsive to the boat hull being in a distressed condition so that the boat is prevented from sinking by the inflated plurality of flotation containers. The apparatus of the combination also preferably includes a plurality of moisture sensors each positioned in the boat hull to sense the distressed condition and a distressed condition controller positioned in communication with the plurality of moisture sensors and the plurality of flotation containers to control the inflation of the plurality of flotation containers responsive to at least one of the plurality of moisture sensors sensing the distressed condition.

22 Claims, 6 Drawing Sheets

FIG. 5B.
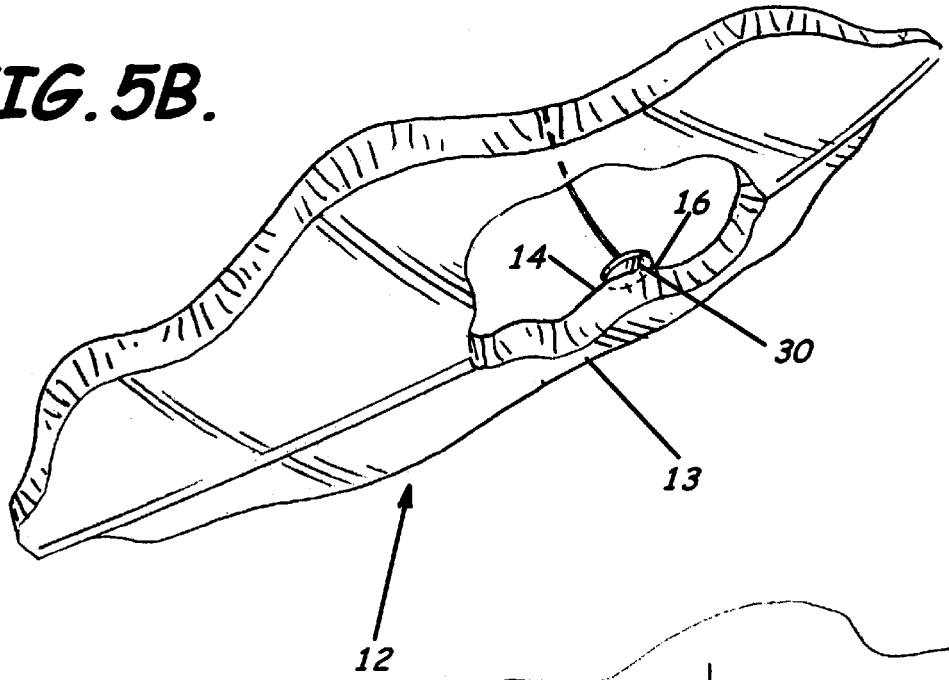
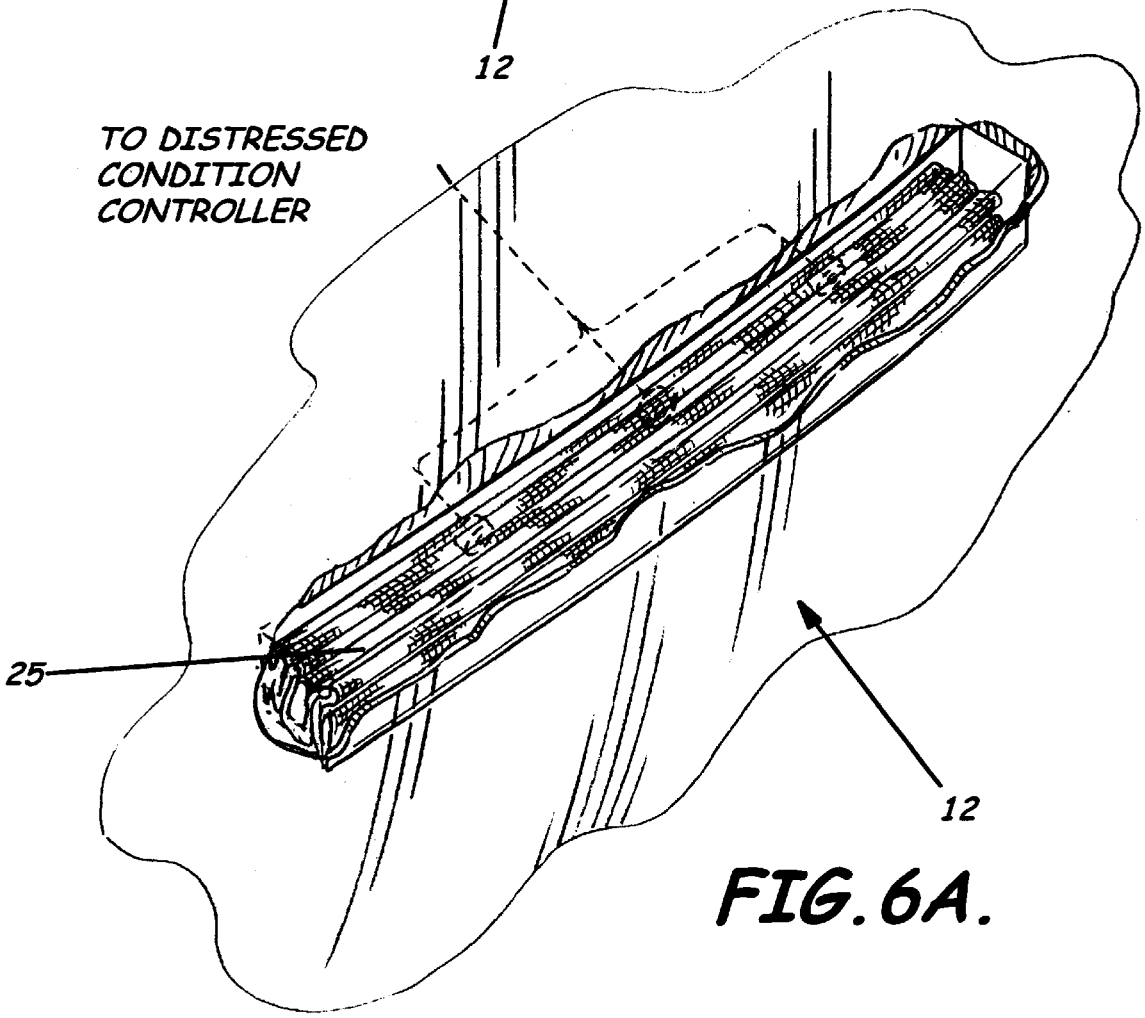
FIG. 6A.

COMBINATION BOAT AND DISTRESSED BOAT FLOTATION APPARATUS AND RELATED METHODS

FIELD OF THE INVENTION

The present invention relates to the boat industry and, more particularly, to the field of boat protective devices and methods.

BACKGROUND OF THE INVENTION

In the boat industry, over the years, boats, and particularly boat hulls, have been damaged by rocks, sand bars, storms, fires, poor construction, and various other reasons. The result is often a distressed boat out in the middle of a body of water such as an ocean, a sea, a lake, or river. The crew or passengers of a distressed boat may have an emergency kit or equipment such as life jackets, flares, rafts, food rations, radio equipment, or the like to assist in initiating distress signals to the Coast Guard, other agencies, or potential rescuers. The emergency equipment may allow crew or passengers to be rescued if rescue personnel arrive in time. The rescue personnel, however, often are not able to help or rescue the boat itself. Also, the damage to the hull of the boat often causes the boat to sink and often with boating equipment, crew, and passengers on the boat. Even if crew or passengers are not hurt, the boat itself and the boating equipment often can be quite expensive and can be a severe loss for the owner as well as insurance companies. Unless treasure or some other extraordinarily expensive equipment is on the boat, the costs associated with trying to raise the boat from the depth of a body of water are often prohibitive.

SUMMARY OF THE INVENTION

With the foregoing in mind, the present invention advantageously provides a combination boat and distressed boat flotation apparatus, a distressed boat flotation apparatus, and methods of installing and using a boat flotation apparatus which prevents a boat from sinking so that the boat and crew or passengers can be rescued more effectively. The present invention also advantageously provides a combination boat and distressed boat flotation apparatus, a distressed boat flotation apparatus, and methods of installing and using a boat flotation apparatus which saves the expense of a complete loss of a boat and assist in reducing insurance costs associated with expensive boats and equipment sinking. The present invention also advantageously provides a combination boat and distressed boat flotation apparatus, a distressed boat flotation apparatus, and methods of installing and using a boat flotation apparatus which enhances locating a distressed boat, assists crew and passengers on the distressed boat in notifying rescue personnel of the distressed condition, and assists crew and passengers in surviving while waiting until rescue personnel arrive.

More particularly, the present invention provides a combined boat and distressed boat flotation apparatus which preferably has a boat including a boat hull having an outer surface and an inner surface and a plurality of flotation containers positioned to substantially surround the boat hull when inflated with a gas responsive to the boat hull being in a distressed condition so that the boat is prevented from sinking by the inflated plurality of flotation containers. The distressed condition preferably is defined by water passing through the outer surface of the boat hull into contact with the inner surface of the boat hull when the boat is positioned in a body of water or the boat capsizing. The combination also preferably includes a plurality of spaced-apart moisture sensors each embedded in the boat hull to sense the distressed condition and a distressed condition controller positioned in communication with the plurality of moisture sensors and the plurality of flotation containers to control the inflation of the plurality of flotation containers responsive to at least one of the plurality of moisture sensors sensing the distressed condition.

The present invention also provides a distressed boat flotation apparatus which preferably includes a plurality of flotation containers adapted to be positioned to substantially surround a boat hull of a boat when inflated with a gas responsive to the boat hull being in a distressed condition so that the boat is prevented from sinking by the inflated plurality of flotation containers. The distressed condition preferably is defined when water passes through the outer surface of the boat hull into contact with the inner surface of the boat hull when the boat is positioned in a body of water or the boat being capsized. The apparatus also preferably includes a plurality of spaced-apart moisture sensors each embedded in the boat hull to sense the distressed condition and a distressed condition controller positioned in communication with the plurality of moisture sensors and the plurality of flotation containers to control the inflation of the plurality of flotation containers responsive to at least one of the plurality of moisture sensors sensing the distressed condition.

The present invention additionally provides a method of installing a boat flotation apparatus on a boat. The method preferably includes positioning a plurality of moisture sensors within a boat hull of a boat and positioning a plurality of flotation containers to substantially surround the boat hull when inflated.

Another method of preventing a boat from sinking responsive to damage to the hull of the boat according to the present invention preferably includes sensing water passing through the boat hull and inflating a plurality of flotation containers positioned to substantially surround the boat hull when inflated and to float the boat therewith thereby preventing sinking of the boat.

BRIEF DESCRIPTION OF THE DRAWINGS

Some of the features, advantages, and benefits of the present invention having been stated, others will become apparent as the description proceeds when taken in conjunction with the accompanying drawings in which:

FIG. 5B is a fragmentary perspective view of a single hull of a boat having a plurality of moisture sensors positioned in the boat hull and an associated distressed condition controller of a distressed boat flotation apparatus according to a second embodiment of the present invention;

FIG. 6A is a fragmentary perspective view of a flotation container having portions broken away for clarity of a distressed boat flotation apparatus according to the present invention;

DETAILED DESCRIPTION OF PREFERRED EMBODIMENTS

The present invention will now be described more fully hereinafter with reference to the accompanying drawings which illustrate preferred embodiments of the invention. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout, the prime notation, if used, indicates similar elements in alternative embodiments.

Figure 1:
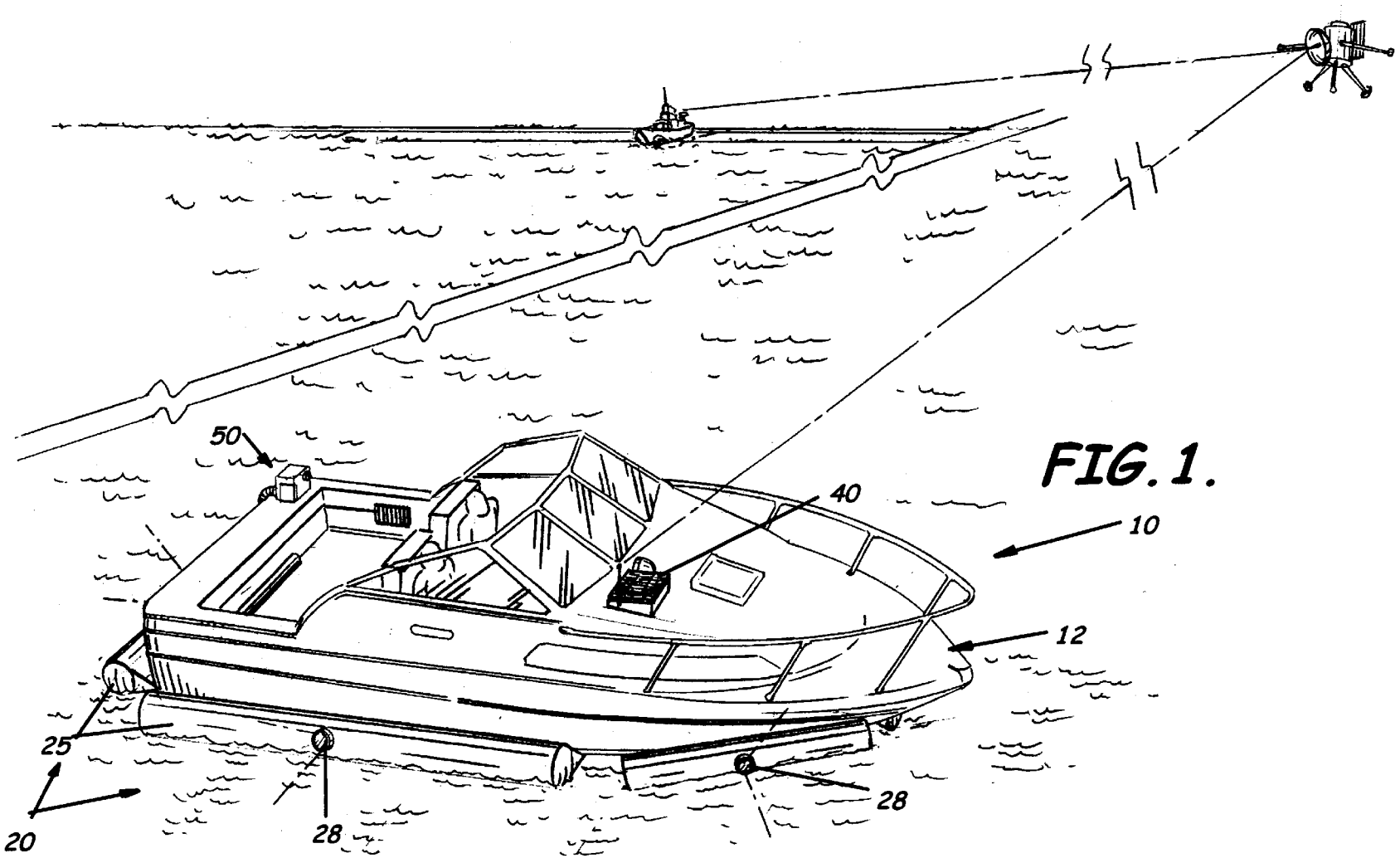
FIG. 1 is an environmental perspective view of a combination boat and distressed boat flotation apparatus according to the present invention.
Figure 2:
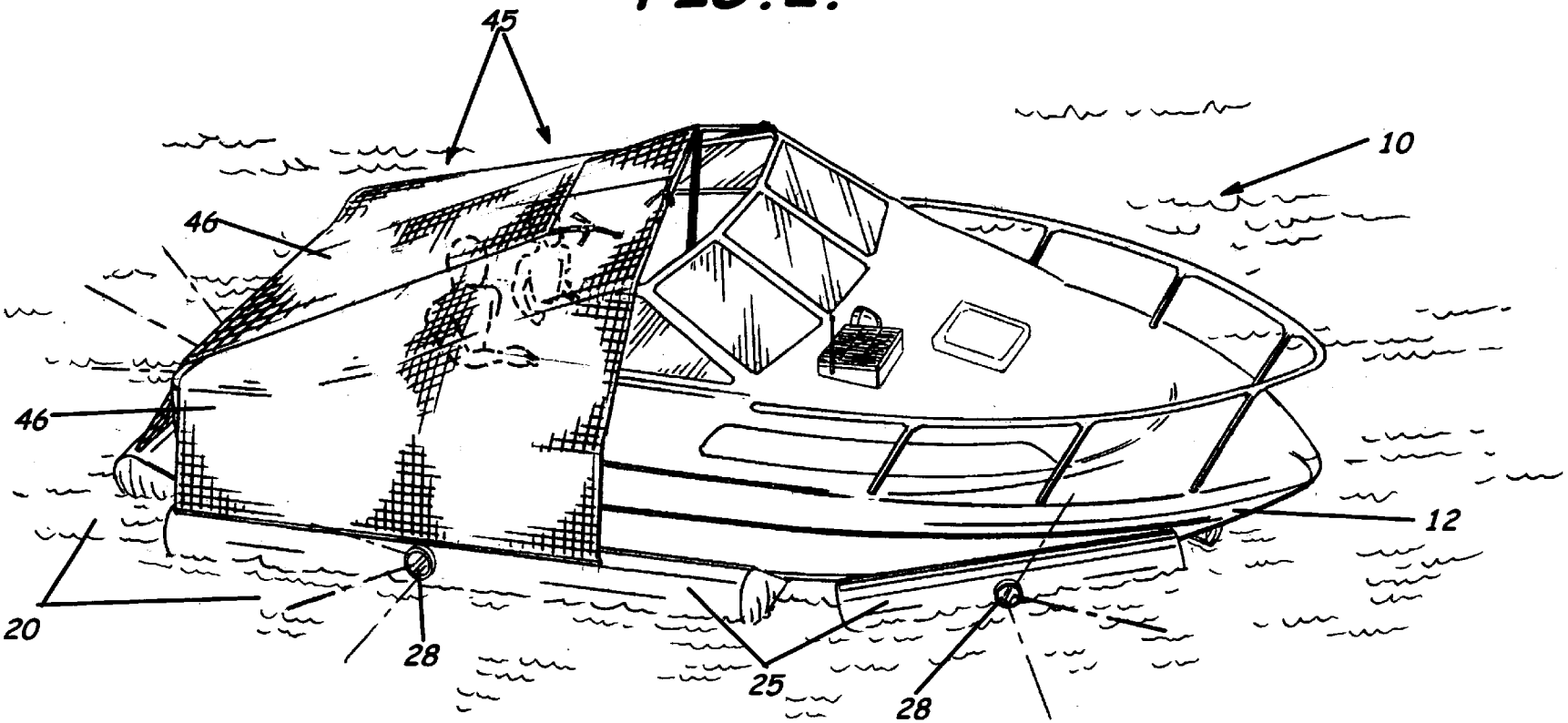
FIG. 2 is an environmental perspective view of a combination boat and distressed boat flotation apparatus according to the present invention.
Figure 3:
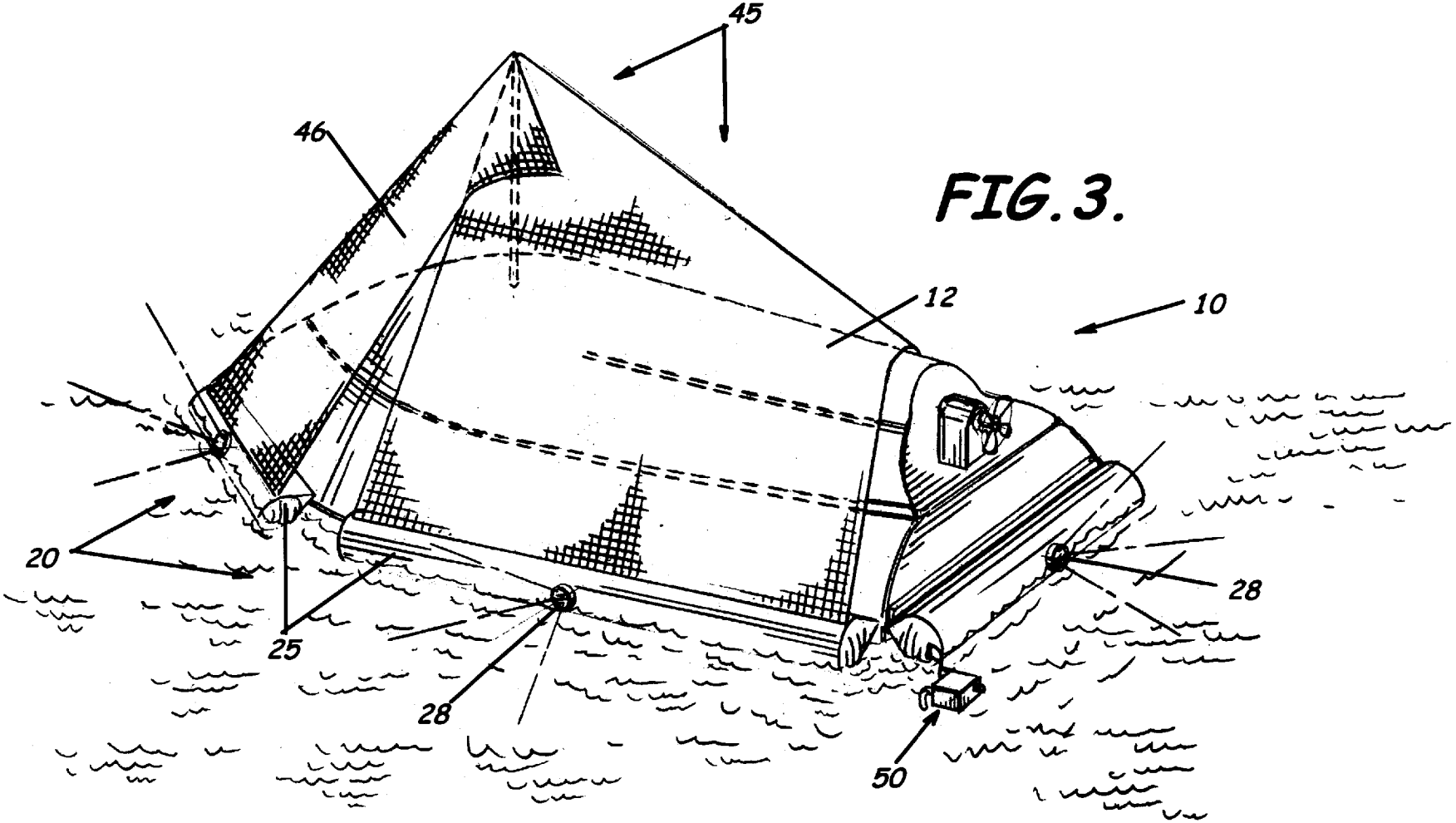
FIG. 3 is an environmental perspective view of a combination boat and distressed boat flotation apparatus according to the present invention.
Figure 4A:
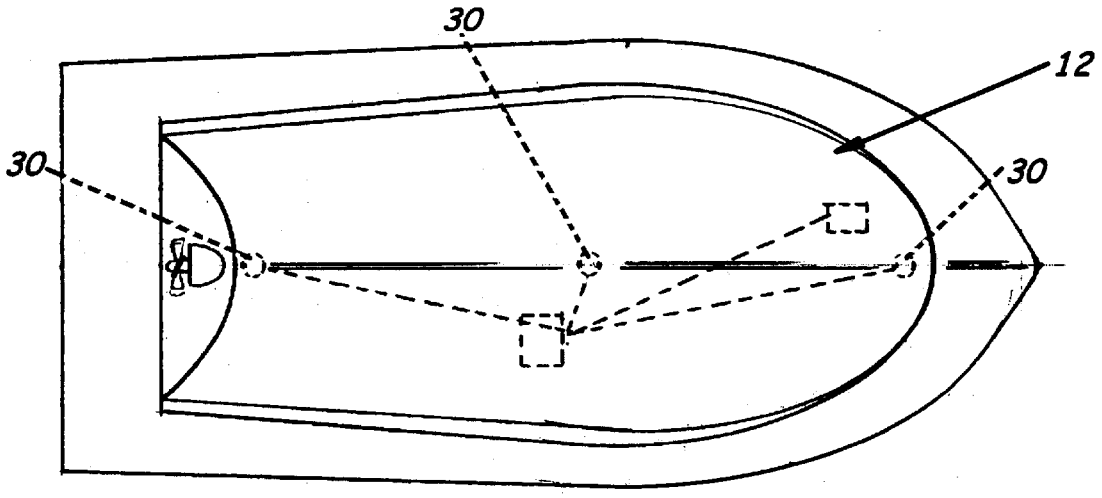
FIG. 4A is a top plan view of an inner surface of a boat hull of a boat having a plurality of moisture sensors positioned in the boat hull and an associated distressed condition controller of a distressed boat flotation apparatus according to a first embodiment of the present invention.
Figure 4B:
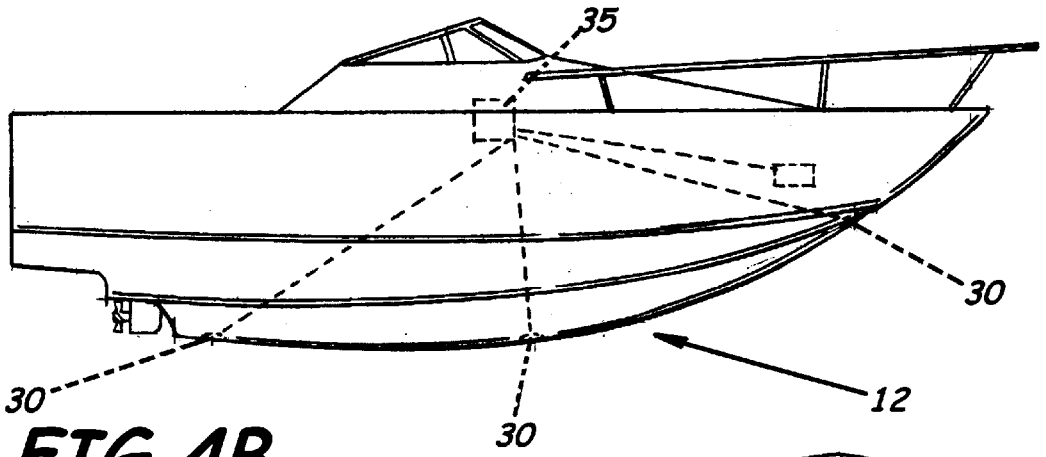
FIG. 4B is a side plan view of an outer surface of a boat hull of a boat having a plurality of moisture sensors positioned in the boat hull and an associated distressed condition controller of a distressed boat flotation apparatus according to a first embodiment of the present invention.
Figure 5A:
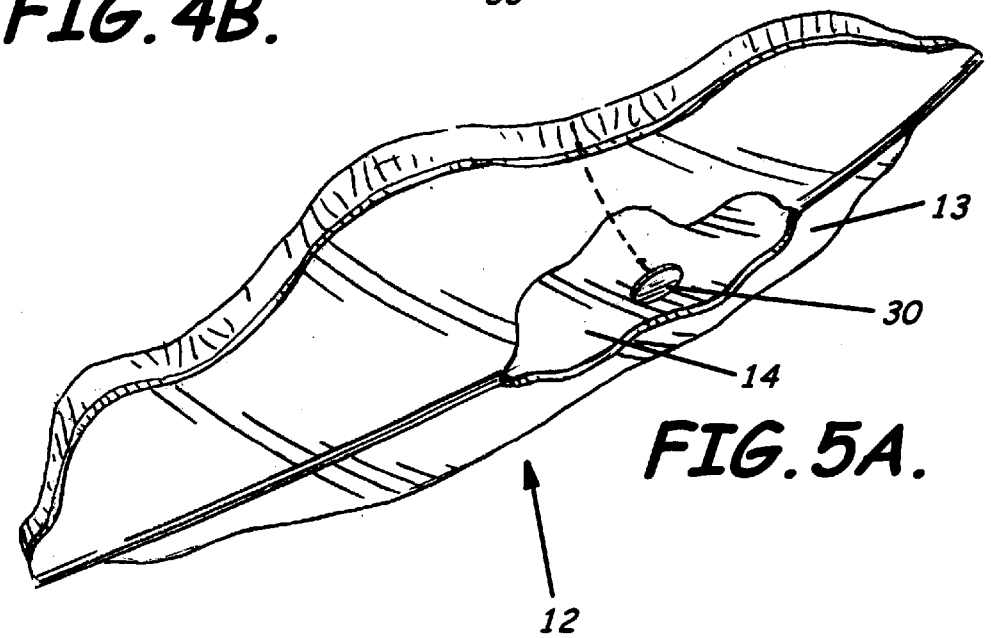
FIG. 5A is a fragmentary perspective view of inner and outer surfaces of a boat hull of a boat having a plurality of moisture sensors positioned in the boat hull and an associated distressed condition controller of a distressed boat flotation apparatus according to a second embodiment of the present invention.
Figure 6B:
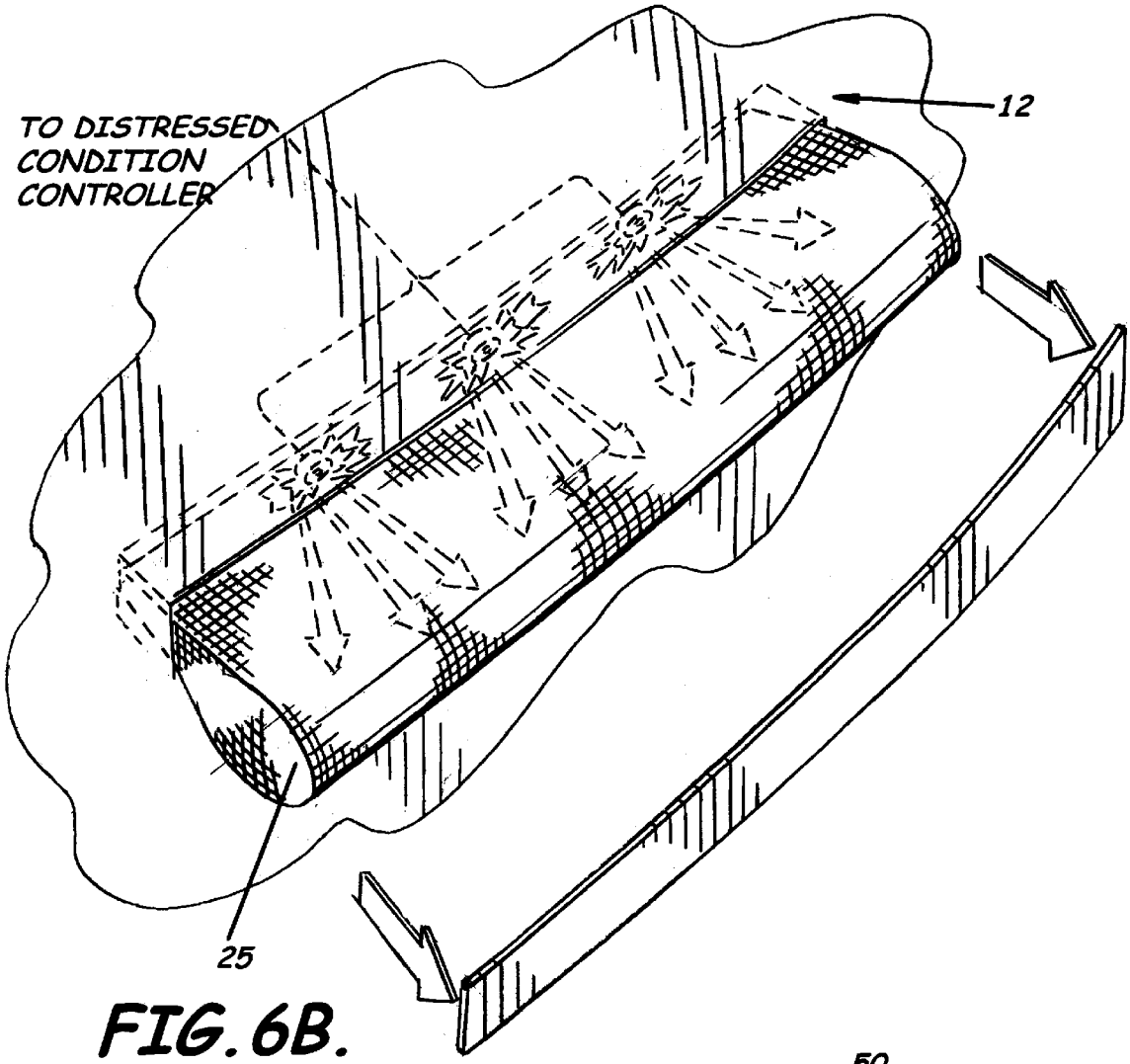
FIG. 6B is a fragmentary perspective view of an flotation container having portions broken away for clarity of a distressed boat flotation apparatus according to the present invention.
Figure 7:
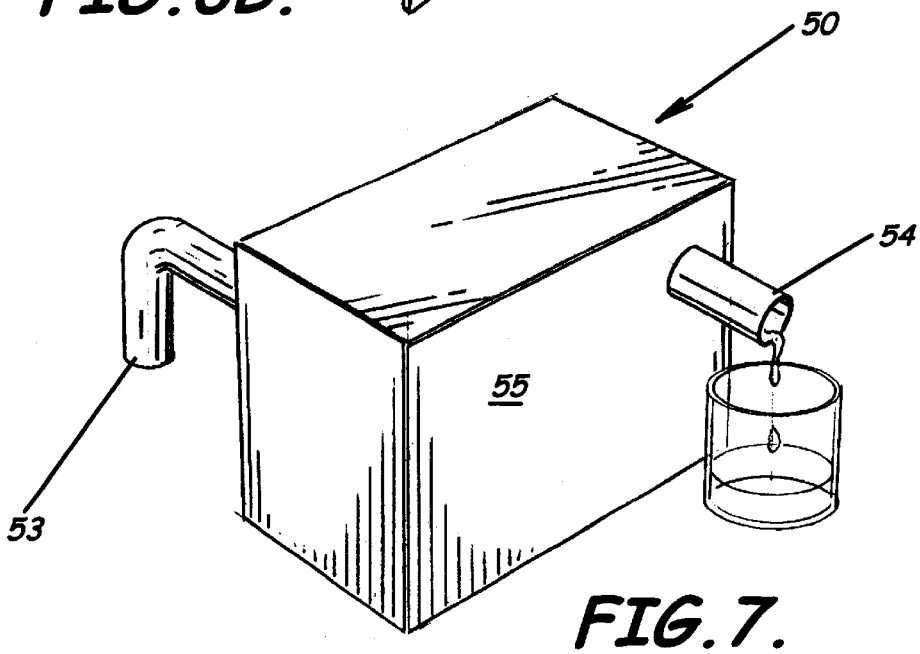
FIG. 7 is a perspective view of a water purifying device of a distressed boat flotation apparatus according to the present invention.

FIGS. 1–6 illustrate a combined boat and distressed boat flotation apparatus according to the present invention which preferably has a boat 10 including a boat hull 12 having an outer surface 13 and an inner surface 14 and a distressed boat flotation apparatus 20 preferably including a plurality of flotation containers 25, e.g., air bags or other containers which can be quickly inflated as understood by those skilled in the art, positioned to substantially surround the boat hull 12 when inflated with a gas responsive to the boat hull 12 being in a distressed condition so that the boat 10 is prevented from sinking by the inflated plurality of flotation containers 25. The distressed condition preferably is defined by water passing through the outer surface 13 of the boat hull 12 into contact with the inner surface 14 of the boat hull 12 when the boat 10 is positioned in a body of water. Each of the plurality of flotation containers 25 preferably is formed of a puncture-resistant and fire-resistant material as understood by those skilled in the art. The distressed condition can also be defined by the boat 10 being capsized, i.e., turned over so that the boat hull 12 is out of the water and a passenger compartment is in the water. The plurality of moisture sensors 30 also preferably includes boat capsizing sensors embedded in the boat hull 12 and in communication with the distressed condition controller to control the inflation of the plurality of flotation containers responsive to the boat capsizing sensor. The boat capsizing sensor can be provided by a level, for example, that detects the position of the boat on the horizon and inflates the plurality of flotation containers 25 responsive to a predetermined level of the boat on the horizon, i.e., if the level indicates that the boat is turned over, then the flotation containers 25 are inflated to prevent the boat 11 from sinking.

The distressed boat flotation apparatus 20 individually and of the combination also preferably includes a plurality of moisture sensors 30 each embedded in the boat hull 12 to sense the distressed condition and a distressed condition controller 35 positioned in communication with the plurality of moisture sensors 30 and the plurality of flotation containers 25 to control the inflation of the plurality of flotation containers 25 responsive to at least one of the plurality of moisture sensors 30 sensing the distressed condition. More specifically, the moisture sensors 30 are embedded between the outer 13 and inner 14 surfaces of the boat hull 12 so that if there exists a breach in the integrity of the outer surface of the boat hull 13, i.e., water seeping through a crack in the outer surface of the boat hull 13, the moisture sensors 30 are activated and the plurality of flotation containers are inflated to substantially surround the boat and prevent it from sinking.

The apparatus 20 can also include a plurality of lights 28 each associated with a respective one of the plurality of flotation containers 25. Each of the plurality of lights 28 preferably is responsive to the respective one of the plurality of flotation containers 25 being inflated during the distressed condition. Each of the plurality of lights 28 also preferably include a moisture sensor associated therewith. Each of the plurality of lights are therefore also preferably responsive to the moisture sensors. In other words, after the flotation containers have been inflated and the lights connected thereto contact moisture, the lights will be activated. The lights may be flourescent lights, strobe lights, or any other type of lights to draw attention to the distressed boat as understood by those skilled in the art. Also, a solar-powered, global positioning device 40, e.g., GPS device as understood by those skilled in the art, preferably is positioned associated with the boat 10, e.g., mounted to a control panel in the boat, in or adjacent the flotation containers 25, or in or adjacent the hull 12, in communication with the distressed condition controller 35, and in communication with a satellite communication system to communicate the location of the boat 10 when in the distressed condition. This is advantageous in that it allows rescuers to readily locate the boat in the distressed condition in cases where no other communication is possible with persons stranded on the distressed boat.

Additionally, the apparatus 20 can advantageously include a boat occupant shelter 45 associated with the plurality of inflated flotation containers 25 to shelter boat occupants from damaging weather conditions, e.g., sun, wind, rain, or cold weather, during the distressed condition. The boat occupant shelter 45 preferably has at least one sheet 46, and more preferably a plurality of sheets 46 or other structures to form a tent, a covering, or other shelter, formed of a fabric material and positioned to connect to and extend between at least two of the plurality of inflated flotation containers 25 so that boat occupants can underlie the at least one sheet 46 and thereby be protected from damaging weather conditions.

The apparatus 20 can further advantageously include a water purification device 50 associated with the boat 10 to purify water for boat occupants during the distressed condition. The water purification device 50 preferably includes a water desalinater 52 to desalinate salt water for drinking by boat occupants during the distressed condition. The water desalinater 52 preferably has a salt water intake 53 positioned to intake salt water, a salt water purifier 55 positioned in fluid communication with the salt water intake 53 to remove salt from the intake salt water, e.g., from the ocean, and a purified water output 54 positioned in fluid communication with the salt water purifier 55 to output purified water to boat occupants during the distressed condition.

As illustrated in the drawings and as described above, the present invention additionally provides a method of installing a boat flotation apparatus 20 on a boat 10. The method preferably includes embedding a plurality of moisture sensors 30 within a boat hull 12 of a boat 10 and positioning a plurality of flotation containers 25 to substantially surround the boat hull 12 when inflated. The plurality of flotation containers 25 are positioned in communication with the plurality of moisture sensors 30. The method can also include positioning a distressed condition controller 35 in communication with the plurality of moisture sensors 30 and the plurality of flotation containers 25 to control inflation of the flotation containers 25 responsive to the sensing of a distressed condition. The distressed condition preferably includes the sensing of water passing through the boat hull 12 or the boat capsizing. The embedding of the plurality of moisture sensors 25 preferably includes forming a plurality of recesses 16 in an inner surface 14 of a boat hull 12, inserting a respective one of the plurality of moisture sensors 25 in a respective one of the plurality of recesses 16, and covering each one of the respective plurality of moisture sensors 25 so that each one of the respective plurality of moisture sensors 25 are embedded between the inner surface 14 of the boat hull and the outer surface 13 of the boat hull. The embedding of the plurality of moisture sensors 25 also can include embedding each of the plurality of moisture sensors 25 between an inner surface 14 and an outer surface 13 of a boat hull 12.

Also according to the present invention, a method of preventing a boat 10 from sinking responsive to damage to the hull 12 of the boat 10 is provided which preferably includes sensing water passing through the boat hull 12 and inflating a plurality of flotation containers 25 positioned to substantially surround the boat hull 12 when inflated and to float the boat 10 therewith, thereby preventing sinking of the boat 10. The method can also include indicating the location of the floating boat 10 to rescue personnel. The step of indicating can include communicating to a satellite the location of the floating boat 10 and/or illuminating lights 28 associated with the floating boat 10.

In the drawings and specification, there have been disclosed a typical preferred embodiment of the invention, and although specific terms are employed, the terms are used in a descriptive sense only and not for purposes of limitation. The invention has been described in considerable detail with specific reference to these illustrated embodiments. It will be apparent, however, that various modifications and changes can be made within the spirit and scope of the invention as described in the foregoing specification and as defined in the appended claims.

That which is claimed is:

1. A combined boat and distressed boat flotation apparatus comprising:

a boat including a boat hull having an outer surface and an inner surface;

a plurality of containers positioned to substantially surround the boat hull when inflated with a gas responsive to the boat hull being in a distressed condition so that the boat is prevented from sinking by the inflated plurality of flotation containers, the distressed condition being defined by liquid water passing through the outer surface of the boat hull into contact with the inner surface of the boat hull when the boat is positioned in a body of water;

a plurality of spaced-apart moisture sensors each embedded in the boat hull to sense the distressed condition; and a distressed condition controller positioned in communication with the plurality of moisture sensors and the plurality of flotation containers to control the inflation of the plurality of flotation containers responsive to at least one of the plurality of moisture sensors sensing the distressed condition.

2. A combination as defined in claim 1, further comprising a solar-powered, global positioning device associated with the boat, in communication with the distressed condition controller, and in communication with a satellite communication system to communicate the location of the boat when in the distressed condition.

3. A combination as defined in claim 1, further comprising a boat occupant shelter associated with the plurality of inflated flotation containers to shelter boat occupants from damaging weather conditions during the distressed condition.

4. A combination as defined in claim 3, wherein the boat occupant shelter comprises at least one sheet formed of a fabric material and positioned to connect to and extend between at least two of the plurality of inflated flotation containers so that boat occupants can underlie the at least one sheet and thereby be protected from damaging weather conditions.

5. A combination as defined in claim 1, further comprising a water purification device associated with the boat to purify water for boat occupants during the distressed condition.

6. A combination as defined in claim 5, wherein the water purification device includes a water desalinater to desalinate salt water for drinking by boat occupants during the distressed condition, the water desalinater having a salt water intake positioned to intake salt water, a salt water purifier positioned in fluid communication with the salt water intake to remove salt from the intake salt water, and a purified water output positioned in fluid communication with the salt water purifier to output purified water to boat occupants during the distressed condition.

7. A combination as defined in claim 1, wherein the distressed condition is further defined as the boat being capsized and wherein each of the plurality of moisture sensors further comprise a boat capsizing sensor to control the inflation of the plurality of flotation containers responsive to the boat capsizing sensor.

8. A distressed boat flotation apparatus comprising:

a plurality of flotation containers positioned to substantially surround a boat hull of a boat when inflated with a gas responsive to the boat hull being in a distressed condition so that the boat is prevented from sinking by the inflated plurality of flotation containers, the distressed condition being defined by liquid water passing through the outer surface of the boat hull into contact with the inner surface of the boat hull when the boat is positioned in a body of water;

a plurality of spaced-apart moisture sensors each embedded in the boat hull to sense the distressed condition; and a distressed condition controller positioned in communication with the plurality of moisture sensors and the plurality of flotation containers to control the inflation of the plurality of flotation containers responsive to at least one of the plurality of moisture sensors sensing the distressed condition.

9. An apparatus as defined in claim 8, further comprising a solar-powered, global positioning device adapted to be positioned associated with the boat, in communication with the distressed condition controller, and in communication with a satellite communication system to communicate the location of the boat when in the distressed condition.

10. An apparatus as defined in claim 8, further comprising a boat occupant shelter associated with the plurality of inflated flotation containers to shelter boat occupants from damaging weather conditions during the distressed condition.

11. An apparatus as defined in claim 8, wherein the boat occupant shelter comprises at least one sheet formed of a fabric material and positioned to connect to and extend between at least two of the plurality of inflated flotation containers so that boat occupants can underlie the at least one sheet and thereby be protected from damaging weather conditions.

12. An apparatus as defined in claim 8, further comprising a water purification device adapted to be associated with the boat to purify water for boat occupants during the distressed condition.

13. An apparatus as defined in claims 12, wherein the water purification device includes a water desalinater to desalinate salt water for drinking by boat occupants during the distressed condition, the water desalinater having a salt water intake positioned to intake salt water, a salt water purifier positioned in fluid communication with the salt water intake to remove salt from the intake salt water, and a purified water output positioned in fluid communication with the salt water purifier to output purified water to boat occupants during the distressed condition.

14. An apparatus as defined in claim 8, wherein the distressed condition is further defined as the boat being capsized and wherein each of the plurality of moisture sensors further comprise a boat capsizing sensor to control the inflation of the plurality of flotation containers responsive to the boat capsizing sensor.

15. A method of installing a boat flotation apparatus on a boat, the method comprising:

embedding a plurality of moisture sensors within a boat hull of a boat to sense the presence of liquid water when the liquid water passes through the boat hull; and positioning a plurality of flotation containers to substantially surround the boat hull when inflated, the plurality of flotation containers in communication with the plurality of moisture sensors.

16. A method as defined in claim 15, further comprising positioning a distressed condition controller in communication with the plurality of moisture sensors and the plurality of flotation containers to control inflation of the flotation containers responsive to the sensing of a distressed condition, the distressed condition being the sensing of water passing through the boat hull.

17. A method as defined in claim 15, wherein the embedding of the plurality of moisture sensors includes forming a plurality of recesses in an inner surface of a boat hull, inserting a respective one of the plurality of moisture sensors in a respective one of the plurality of recesses, and covering each one of the respective plurality of moisture sensors so that each one of the respective plurality of moisture sensors are embedded between the inner surface of the boat hull and an outer surface of the boat hull.

18. A method as defined in claim 15, wherein the embedding of the plurality of moisture sensors includes positioning each of the plurality of moisture sensors to contact an inner surface of a boat hull.

19. A method of preventing a boat from sinking responsive to damage to the hull of the boat, the method comprising:

sensing water passing through the boat hull; and inflating a plurality of flotation containers positioned to substantially surround the boat hull when inflated to float the boat therewith thereby preventing sinking of the boat responsive to the sensed liquid water.

20. A method as defined in claim 19, further comprising indicating the location of the floating boat to rescue personnel.

21. A method as defined in claim 20, wherein the indicating step includes communicating to a satellite the location of the floating boat.

22. A method as defined in claim 20, wherein the indicating step includes illuminating lights associated with the floating boat.

* * * * *